United States Patent [19]

Westlund, Jr. et al.

[11] Patent Number: 4,622,487

[45] Date of Patent: Nov. 11, 1986

[54] ELECTRIC LAMP WITH STRESS RELIEVING MEANS

[75] Inventors: Arnold E. Westlund, Jr.; Freddie P. Hughes, both of Winchester, Ky.

[73] Assignee: GTE Products Corporation, Stamford, Conn.

[21] Appl. No.: 690,079

[22] Filed: Jan. 9, 1985

[51] Int. Cl.[4] ..... H01J 1/88; H01J 19/42; H01K 1/18

[52] U.S. Cl. ..... 313/273; 313/272; 313/251; 313/285

[58] Field of Search ..... 313/270, 271, 273, 274, 313/275, 276, 251, 264, 269, 285, 331

[56] References Cited

U.S. PATENT DOCUMENTS

| | | | |
|---|---|---|---|
| 2,916,650 | 12/1959 | Honing et al. | 313/276 |
| 3,466,489 | 9/1969 | Audesse et al. | 313/276 |
| 3,543,962 | 12/1970 | Peterson | 313/276 |
| 3,569,988 | 3/1971 | Randmer | 313/269 |
| 3,870,920 | 3/1975 | De Fraeye et al. | 313/275 |
| 4,023,060 | 5/1977 | Pike et al. | 313/276 |

*Primary Examiner*—Saxfield Chatmon
*Attorney, Agent, or Firm*—Lawrence R. Fraley

[57] ABSTRACT

An electric lamp (e.g., tungsten-halogen) wherein a glass bridge (31) is used and has the support wires (23) of the lamp's filament structure (13) passing therethrough. The support wires are indented (e.g., with V-shaped notches) on opposing sides thereof just below the bridge to permit movement of the portions of the support wires between the bridge and press-sealed end (17) of the lamp's envelope (11) during press-sealing, thereby substantially relieving stresses on the bridge (31) and possible breakage thereof as may occur if such wires were retained in a fixed, non-movable arrangement.

8 Claims, 5 Drawing Figures

ELECTRIC LAMP WITH STRESS RELIEVING MEANS

TECHNICAL FIELD

This invention is concerned with electric lamps and more particularly to such lamps which contain glass bridges to support the filament structure thereof.

BACKGROUND

Examples of electric lamps which employ at least one glass bridge within the lamp's envelope are shown in U.S. Pat. Nos. 3,466,489 (E. G. Audesse et al) and 4,023,060 (B. Pike et al), both assigned to the assignee of this invention. In many of those lamps also using a press-sealed end to contain the lamp's lead-in wires, (i.e., U.S. Pat. No. 3,466,489), occasional breakage of the glass bridge adjacent the press-sealed end has been found to occur during the press-sealing operation. Such occurrence has proven especially likely as the bridge location approaches the seal proximity. As a result, broken glass from the bridge can lodge within the filament (typically a coiled tungsten filament structure) and/or lie directly in the optical path of the lamp. In addition, the resulting lamp appearance may not be cosmetically pleasing to the potential customer. Lastly, disattachment of the bridge (or portions thereof) from either of the support wires forming part of the filament structure can result in premature lamp failure.

It is believed that an electric lamp wherein means is provided for substantially preventing breakage of the lamp's glass bridge during lamp formation would constitute an advancement in the art.

DISCLOSURE OF THE INVENTION it is an object of the invention to enhance the electric lamp art by providing a lamp wherein means is provided for substantially preventing breakage of the lamp's glass bridge during formation (press-sealing) of the lamp.

In accordance with one aspect of the invention, there is provided an improved electric lamp having a glass envelope including a press-sealed end portion, a filament structure located within the envelope and including at least one coiled filament and a pair of support wires, and a glass bridge located within the envelope adjacent the press-sealed end portion. The support wires provide support for the coiled filament within the envelope and pass through the glass bridge and into the press-sealed end portion. The improvement comprises the provision of means for permitting movement of at least one of the support wires relative to the glass bridge during formation of the press-sealed end portion to thereby substantially prevent breakage of the glass bridge during this formation.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
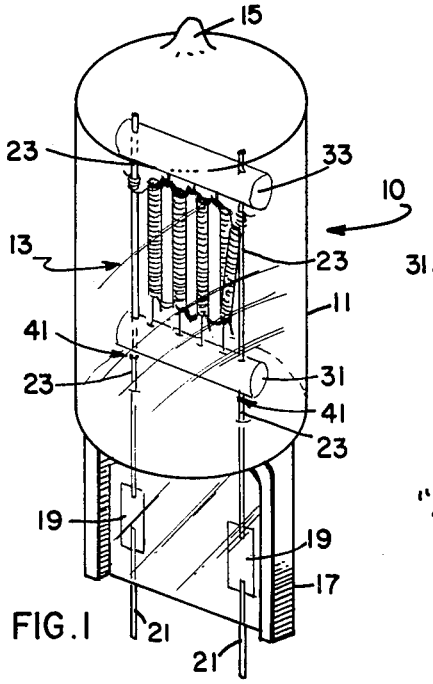
FIG. 1 is a perspective view of an electric lamp in accordance with a preferred embodiment of the invention.

In FIG. 1, there is shown an electric lamp 10 including a glass envelope 11 in which is contained a coiled tungsten filament structure 13. Lamp 10 is preferably a tungsten-halogen lamp of the variety described in aforementioned U.S. Pat. No. 3,466,489. The teachings of this patent are thus incorporated herein by reference. The envelope 11, typically quartz or borosiliate glass, includes a tipped-off end portion 15 and an opposing, press-sealed end portion 17. Located within end portion 17 are a pair of foil (e.g., molybdenum sheet) members 19 which each serve to connect a respective lead-in wire 21 (which, as shown, projects externally of end portion 17) and one of the two, electrically conductive support wires 23 which in turn form part of filament structure 13. As shown, structure 13 includes a plurality of individual tungsten coils electrically coupled in a series relationship and suspended by the ends thereof from each of the two, opposed glass bridges 31 (lower) and 33 (upper) which also form part of structure 13. Such a filament structure is referred to in the lamp art as a C13 or C13D. Although a multicoiled filament structure having opposed glass bridges is illustrated, the teachings of this invention are readily applicable to a filament structure wherein only one coiled filament and only one glass bridge is utilized. Reference is again made to U.S. Pat. No. 3,466,489 for this latter arrangement.

To form end portion 17, a relatively harsh procedure known in the art as press-sealing is utilized during which metal (e.g., steel) press members engage opposing sides of the tubular glass member which eventually forms envelope 11. Compression of the heated glass tubing occurs, resulting in the configuration depicted in FIG. 1. End segments of wires 21 and 23 are sealed within the newly formed end 17, in addition to the molybdenum foil members 19.

As stated, it has been found that breakage of the lower glass bridge (31) has occasionally occurred during the aforementioned relatively harsh press-sealing operation. This has proven especially true in situations wherein the lead-in wires 21 are joined together at the bottoms thereof by a common loop member (not shown) or the like in what is often referred to in the art as a "spade assembly". After final sealing of envelope 11, this loop is of course removed. Closer observations have indicated that the lower bridge breakage occurs due to stress created on the lower bridge as a result of outward, lateral movement of at least one and usually both of the two support wires 23 during the aforementioned press member engagement and compression of end portion 17. By outward lateral movement is meant movement along a plane passing through both of the linear support wires 23 in a direction away from the longitudinal (center) axis of envelope 11.

Figure 2:
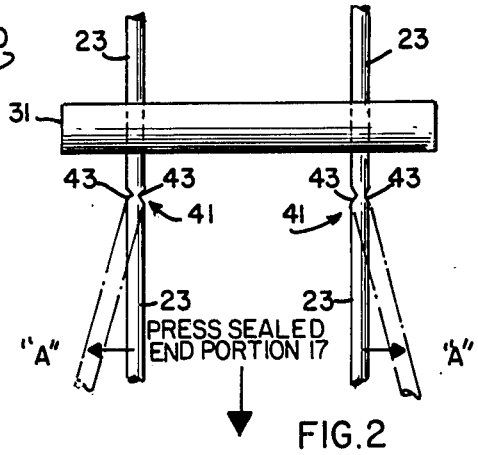
FIG. 2 is an enlarged view of the lower (bottom) glass bridge of the lamp of FIG. 1, showing portions of the two support wires passing therethrough.

To overcome this, there is provided within each of the support wires 23 means 41 for permitting wires 23 to move outwardly (direction "A") during press-sealing (FIG. 2). Means 41 comprises a pair of indentations 43 located on opposite sides of each wire 23 immediately below lower bridge 31 and thus also between bridge 31 and end portion 17.

Figure 3A:
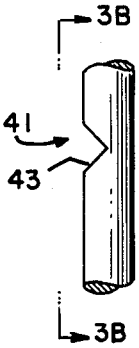
FIGS. 3A, 3B, 4A, 4B and 5 depict various embodiments of the means of the invention for permitting movement of at least one of the lamp's support wires during formation of the lamp's press-sealed end portion.
Figure 3B:
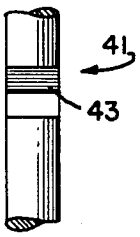
Figure 4A:
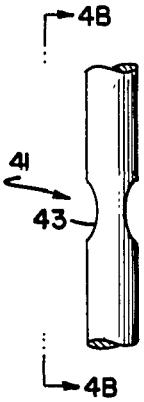
Figure 4B:
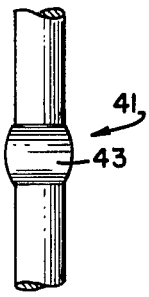
Figure 5:
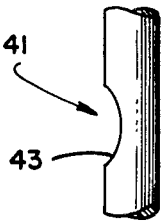

Indentations 43 are each preferably in the form of a V-shaped notch (FIGS. 2, 3A, 3B) or, alternatively, rounded depressions (FIGS. 4A, 4B, 5). Although it is shown in FIG. 2 to employ two indentations per wire, it is within the scope of the invention to use a singular pair of indentations within only one wire 23. Better results (reduced breakage) are possible, however, using the dual arrangement of FIG. 2. It is also within the scope of the invention to provide a single notch or depression within both wires 23 or, alternatively, within only one wire. It is even further possible to utilize a combination of both notch(es) and depression(s) within one or both wires. In all cases, total penetration of approximately one-half of the support wire's diameter is preferred. In one example, support wires having a diameter of 0.032 inch were each penetrated on overall average depth of about 0.014 inch. Surprisingly, electrical conductivity of these wires was not adversely affected.

Formation of indentations 43 is preferably achieved using a suitable notching or swaging mechanism located on and thus forming part of the lamp-making equipment such that the indentations can be formed immediately before positioning of the filament structure within the glass tubing member which eventually forms envelope 11.

A series of tests were performed involving the teachings of the invention as defined herein. In the first of these tests, several C13D filament lamps were press-sealed using some form of relief (i.e., grooves) within the steel press members forming the seal. These grooves were each located within the press member in alignment with a corresponding support wire.

A total of five broken bridges was observed in pressing twenty-two lamps under these conditions. In a second of these tests, similar lamps were again pressed but, in addition to the aforementioned press relief grooves, another groove was provided within the center of each press member (aligning between the two support wires). Two broken bridges results in twenty-four lamps so formed. In a third of these tests, the teachings of the instant invention were employed in addition to the grooves used in the second series of tests. No breakage occurred in nineteen lamps so formed. To confirm these results, another group of forty-nine lamps was tested under similar conditions to the above third series. Only one lamp exhibited breakage to the glass bridge. Finally, fifty lamps were tested under conditions similar to the third series of tests but instead of both support wires being indented, only one such wire was so treated. Only four lamps exhibited bridge breakage.

There has thus been shown and described an electric lamp having therein at least one glass bridge in which is positioned the conductive support wires of the lamp's filament structure. Means (e.g., notches) are located within at least one of the support wires to thereby enable relative movement of the wire during press-sealing of one of the lamp's ends (that containing the support wires and other conductive elements), thus relieving stress in the glass bridge as can occur during such sealing.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an electric lamp having a glass envelope including a press-sealed end portion, a filament structure located within said envelope and including at least one coiled filament and a pair of support wires, and a glass bridge located within said envelope adjacent said press-sealed end portion, said support wires providing support for said coiled filament within said envelope and passing through said glass bridge and into said press-sealed end portion, the improvement comprising:

means for permitting outward lateral movement of at least one of said support wires relative to said glass bridge during formation of said press-sealed end portion to thereby substantially prevent breakage of said glass bridge during said formation.

2. The improvement according to claim 1 wherein said means for permitting said movement is located within at least one of said support wires between said glass bridge and said press-sealed end portion.

3. The improvement according to claim 2 wherein said means for permitting said movement comprises at least one indentation formed within at least one of said support wires immediately below said glass bridge.

4. The improvement according to claim 3 wherein said means for permitting said movement comprises two indentations formed within said support wire on opposite sides thereof.

5. The improvement according to claim 4 wherein said means for permitting said movement comprises two indentations formed within each of said support wires immediately below said glass bridge, said two indentations being located on opposite sides of each of said support wires.

6. The improvement according to claim 3 wherein said indentation is in the form of a V-shaped notch.

7. The improvement according to claim 3 wherein said indentation is in the form of a rounded depression.

8. The improvement according to claim 3 wherein the total depth of penetration within said support wire of said means for permitting said movement is approximately one-half of the diameter of said support wire.

* * * * *